US007347917B2

(12) United States Patent
Ash et al.

(10) Patent No.: US 7,347,917 B2
(45) Date of Patent: Mar. 25, 2008

(54) PAPER INCORPORATING A WIDE ELONGATE IMPERMEABLE ELEMENT, AND A METHOD OF MAKING OF THE SAME

(75) Inventors: Adrian Donald Ash, Basingstoke (GB); Malcolm Paul Baker, Southampton (GB); Duncan Hamilton Reid, Basingstoke (GB)

(73) Assignee: De La Rue International Limited, Basingstoke (GB)

( * ) Notice: Subject to any disclaimer, the term of this patent is extended or adjusted under 35 U.S.C. 154(b) by 332 days.

(21) Appl. No.: 10/494,756

(22) PCT Filed: Nov. 5, 2002

(86) PCT No.: PCT/GB02/05015

§ 371 (c)(1),
(2), (4) Date: May 5, 2004

(87) PCT Pub. No.: WO03/040466

PCT Pub. Date: May 15, 2003

(65) Prior Publication Data

US 2005/0016702 A1 Jan. 27, 2005

(30) Foreign Application Priority Data

Nov. 5, 2001 (GB) ..... 0126578

(51) Int. Cl.
*D21H 21/42* (2006.01)

(52) U.S. Cl. ..... 162/140; 162/116; 428/131; 428/135; 428/136

(58) Field of Classification Search ..... 162/140, 162/116; 428/131, 135, 136
See application file for complete search history.

(56) References Cited

U.S. PATENT DOCUMENTS

| | | | | |
|---|---|---|---|---|
| 4,462,867 | A * | 7/1984 | Fuller | 162/103 |
| 5,093,184 | A * | 3/1992 | Edwards | 428/195.1 |
| 5,405,500 | A * | 4/1995 | Knight | 162/103 |
| 5,688,587 | A * | 11/1997 | Burchard et al. | 442/330 |
| 6,355,140 | B1 * | 3/2002 | Murakami et al. | 162/140 |

FOREIGN PATENT DOCUMENTS

| | | |
|---|---|---|
| EP | 0059056 | 9/1982 |
| EP | 400902 | * 12/1990 |
| GB | 2311303 | 9/1997 |
| WO | 9429119 | 12/1994 |
| WO | 9509274 | 4/1995 |
| WO | 0039391 | 7/2000 |

* cited by examiner

*Primary Examiner*—Eric Hug
*Assistant Examiner*—Dennis R Cordray
(74) *Attorney, Agent, or Firm*—Dykema Gossett PLLC

(57) ABSTRACT

Paper incorporating a wide elongate impermeable element with regions at least partially exposed at one surface of the paper at two sets of windows at spaced locations has its windows formed by two sets of raised portions on the support surface of the papermaking machine. A first set of raised portions has a width transverse to the machine direction in which the paper travels during manufacture which is narrower than the width of the elongate element. A second set of raised portions has a width transverse to the machine direction which is at least equal to the width of the elongate element. During manufacture of the paper the elongate element is brought into contact with both sets of raised portions, with edges of the elongate element being supported by the second set of raised portions.

16 Claims, 2 Drawing Sheets

PAPER INCORPORATING A WIDE ELONGATE IMPERMEABLE ELEMENT, AND A METHOD OF MAKING OF THE SAME

BACKGROUND OF THE INVENTION

1. Field of the Invention

This invention is directed to improvements in paper incorporating a wide elongate impermeable element, to a method of making such paper and to documents made therefrom.

2. The Prior Art

It is generally known to include elongate security elements in security paper, as a security feature. Such elements can be threads, strips or ribbons of, for example, plastics film, metal foil, metallised plastic, metal wire. These security elements are included in the thickness of security paper to render imitation of documents produced from the paper more difficult. These elements help in the verification of security documents as they render the view of the documents in reflected light different from that in transmitted light. To increase the security provided by the inclusion of such an elongate element, it is also known to endow the element itself with one or more verifiable properties over and above its presence or absence. Such additional properties include magnetic properties, electrical conductivities, the ability to absorb x-rays and fluorescence.

As a further security feature, it has been found to be particularly advantageous to provide windows in one side of the surface of the paper, which expose such elongate elements at spaced locations. Examples of methods of manufacturing such paper incorporating security elements with or without windows are described below. It should be noted that references to "windowed thread paper" include windowed paper incorporating any elongate security element.

EP-A-0059056 describes a method of manufacture of windowed thread paper on a cylinder mould paper-making machine. The technique involves embossing the cylinder mould cover and bringing an impermeable elongate security element into contact with the raised regions of an embossed mould cover, prior to the contact entry point into a vat of aqueous stock. Where the impermeable security element makes intimate contact with the raised regions of the embossing, no fibre deposition can occur. After the paper is fully formed and couched from the cylinder mould cover, the contact points are present as exposed regions which ultimately form windows, visible in reflected light, on one side of a banknote paper.

WO-A-93/08327 describes a method of manufacturing windowed thread paper on a Fourdrinier paper-making machine. A rotating embedment means, with a modified profile for embossing, is used to drive an impermeable elongate security element into draining paper stock, on a Fourdrinier wire. The profile of the embedment means is such that raised portions are provided which remain in contact with the security element during the embedment process. Thus, paper fibres are prevented from collecting between the security element and embedment means, such that the security element is subsequently exposed in windowed regions of paper.

For production reasons, in current manufacturing procedures the security element used in windowed or non-windowed paper is preferably oscillated within the paper substrate by a small amount, for example, plus or minus 6 mm from either side of a centre line. This is primarily to assist cutting and guillotining across the thread tracks of stacks of 500 sheets. If the thread was not oscillated, the guillotine blade would be presented with a very sharply defined area, of say 1 to 2 mm wide, of polymer/metal/paper built up from 500 sheets. This tends to blunt or even chip the cutting blade. By oscillating the thread, this area is distributed over a wider area of 10 to 15 mm, easing the passage of the blade through the 500 sheet stack. The result of thread oscillation is that only parallel bars can be used in the design of the windows, if the banknotes made from the paper are all to look the same.

Recent investigations have shown that impermeable threads of 4 mm to 6 mm maximum width can be included in paper using the above methods of paper-making. This is due to the requirement for paper stock to flow around the thread and form complete paper areas on the front of the thread in the finished document.

In Canadian patent specification CA-A-2,122,528, there is described an anti-falsification paper which incorporates a wide impermeable security strip with a width between 2 mm and 4 mm. The paper is of multiply design, with at least two paper layers produced on separate paper machines. The security strip is embedded in a first ply and has perforations along the edges which permit water drainage and hence paper fibre deposition along the edges of the thread. The front of the strip is laid down over raised areas on the embossed cylinder mould cover before the raised areas enter the vat of paper stock so as to create windows of exposed strip in the contact regions. The width of the raised areas is narrower than the strip width to permit permeation through the perforations of the strip by paper fibres. However, the width of the strip is so great that the paper formed on the back of the paper has flaws in the form of arbitrary holes in the region of the strip. A second ply of ordinary paper is independently formed and the two are laminated together and further processed, the second ply thereby covering the flaws in the back of the first ply and providing at least one homogenous paper surface. In another embodiment, a third ply is laminated over the front of the first ply to wholly embed the security strip. In yet another embodiment, the width of the strip is selected to be so wide that no paper forms on the back of the first paper ply to provide a continuous exposed area on the back. The front of the strip is laid on a continuous raised area on the mould cover before the raised areas enter the vat of paper stock to provide a continuous exposed area on the front. A second ply of paper is then laminated to the first ply to form the finished security paper and give a homogenous paper layer on one side and a continuous exposed strip on the other.

In all of the prior art methods described above, the width of the elongate element which can be used is very limited. Furthermore, the areas of the threads which are exposed are restricted in terms of shape, due to the limitation imposed by the required embossings, and in terms of the areas, due to the nature of the paper-making technique itself.

WO00/39391 describes a method of making single ply paper which can have a wide strip at least partially embedded therein. This is achieved by blinding one or more selected areas of a porous support surface, depositing a first layer of paper fibres onto the porous support surface around the blinded areas, bringing an impermeable strip to lie in contact with the blinded areas of the support surface such that at least the edges of the strip overlie the deposited layer, and depositing a further layer of paper fibres over the first layer and the impermeable strip to securely embed the edges of the strip within the paper. The blinded areas are impermeable, which substantially prevents the deposition of fibres thereon before the strip is laid thereover. Thus, substantially no paper fibres are deposited on one side of the strip in a central region between edges of the strip to thereby expose a continuous area of the strip at a first surface of the paper. Additionally a plurality of discrete translucent or transparent windows are formed in a second surface of the paper in which the strip is exposed.

The preferred prior art production methods for windowed security paper require an embossed cylinder mould cover. The use of blinding is not generally used in paper-making techniques for the very reason that the paper is preferred to be uniform and consistent. The appearance of holes and perforations is not a feature which is usually required.

As the impermeable strip contacts the support surface after some paper fibres have already been deposited round the blinded areas, it prevents any further fibre deposition over the blinded areas preserving the designs created in the blinding operation as clear areas. Whilst the use of embossed cylinder moulds covers restricts the width of security threads which can be embedded, with this method it is possible to produce a document with any width of impermeable strip, from say 6 mm up to full document width, with paper "coatings" in any design, including watermarks, on the front side of the document. The back of the paper can be made to contain a continuous exposed strip which can be used for the display of indicia and the like.

However, it has been found that the windows formed by this method do not have sharp, well defined edges, but tend to be non-uniform with paper fibres encroaching into the windows and partially obscuring them. The paper fibres are not long enough to bridge the impermeable material used to blind the mould cover, but tend to mount up around the blinding material. The motion of the cylinder mould rotating in the vat of stock causes the fibre to be washed back into the hole, particularly along the leading edge.

In the method described in EP-A-0059056, however, whilst there is a limitation on the width of the security element which can be incorporated, the edges of the windows are well defined because the elongate security element makes contact with the raised regions of the cylinder mould cover before any paper fibres are deposited. Paper fibres are therefore able to enter the valleys between the raised regions so that the security element is buried in the portions of the paper known as bridges between the windows. However, it has been found that if wide elongate security elements are used in the method of EP-A-0059056, then windows are not formed when the width of the security element is wider than the raised portions of the cylinder mould cover. The edges of the security element sag over the edges of the raised regions and prevent paper fibres from entering the valleys between the raised regions, with the consequence that the security element is continually exposed on the mould cover side of the paper.

It is therefore an object of the present invention to provide an improved method of manufacturing paper incorporating a wide impermeable security element with discrete transparent or translucent windows in which the windows have clearly defined edges and are uniformly formed.

SUMMARY OF THE INVENTION

The invention therefore provides a method of manufacturing paper comprising the steps of first bringing an elongate, flexible, impermeable element into contact with a support surface prior to their entry into a vat of aqueous paper stock, said element having a width of at least 6 mm, then depositing fibres onto the support surface to form paper, the deposition of fibres being carried out in such a manner that as fibres are deposited on the support surface the elongate element is incorporated in the paper with regions of the element at least partially exposed at at least one surface of the paper at at least two sets of windows at spaced locations, said at least two sets of windows being formed by two sets of portions which are raised from the support surface relative to adjacent areas of the support surface, in which a first set of raised portions has a width transverse to a machine direction in which the paper travels during manufacture, which width is narrower than the width of the elongate element, and the second set of raised portions has a width transverse to a machine direction in which the paper travels during manufacture, which width is at least equal to the width of the elongate element, such that during manufacture of the paper the elongate element is brought into contact with both sets of raised portions with edges of the elongate element being supported by the second set of raised portions.

BRIEF DESCRIPTION OF THE DRAWINGS

The invention will now be described, by way of example only, with reference to the accompanying drawings in which.

DETAILED DESCRIPTION OF THE PREFERRED EMBODIMENTS

The method-of manufacturing paper according to the present invention is illustrated with reference to FIG. 1. A porous support surface, for example in the form of a cylinder mould cover 10, is produced in a known way. The mould cover 10 has raised portions formed by embossing, such as those described in EP-A-0059056. The raised portions define the shape of the windows formed in the final paper. In this specification the term "window" includes a transparent or translucent region in the paper of regular or irregular shape and occurrence.

Figure 1:
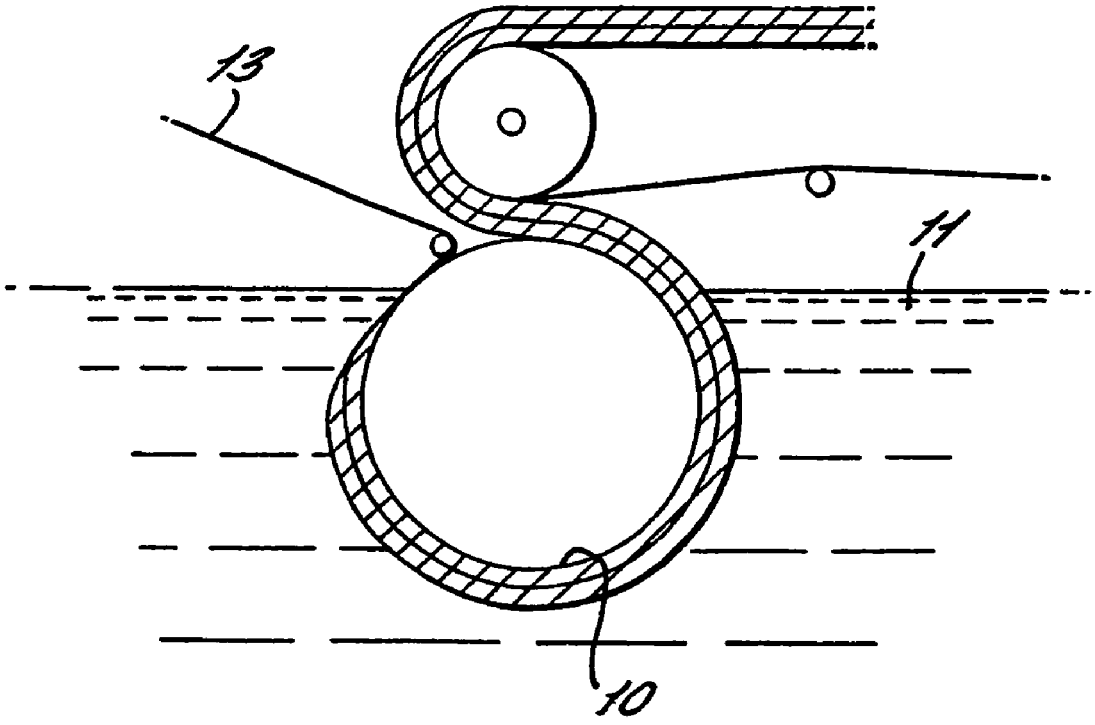
FIG. 1 is a cross-sectional side elevation of a schematic of a paper-making vat for use in the method and manufacturing of paper according to the present invention.

In a known manner, the cylinder mould cover 10 is rotated in a vat of paper stock 11 as illustrated in FIG. 1. The paper stock may comprise fibres of natural materials, such as cotton, synthetic fibres or a mixture of both. As it rotates, a wide flexible elongate impermeable element 13, preferably having a width of at least 6 mm, is brought into contact with the cylinder mould cover 10 above the level of the paper stock.

The raised portions 15, 16 are divided into two sets. A first set 15 preferably provides a repeating pattern, the width of which is less than the width of the elongate element 13. A second set 16 is provided so that at least parts or some elements thereof are located on either side of the first set 15, the distance between the outer edges of said second set 16 corresponds to at least the width of the elongate element 13. The second set of raised portions 16 may comprise individual raised portions on either side of the first set 15, e.g. as shown in FIGS. 2, 4, 5 and 6. Alternatively each or some of the raised portions of the second set 16 may extend the full expected width of the element 13, i.e. having an overall greater width than the first set of raised portions 15, as shown in FIG. 3. It should be noted that any reference to the width of the first or second set of raised portions 15, 16 refer to the width measured transverse to the machine direction. The first set of raised portions 15 define the shape of the main windows and are preferably larger than those provided by the second set 16. Although smaller secondary windows will be provided by the second set of raised portions 16, their main function is to support the edges of the wide elongate element 13 during the manufacturing process and to allow paper fibres to deposit between the windows. Furthermore, the shape of the second set of raised portions 16 can be designed so as to encourage the flow of paper fibres between the raised portions 15, 16, as described below. It is preferable that the security element is not oscillated during the manufacture of the paper to ensure that the edges of the element 13 are in contact with and supported by the second set of raised portions 16.

This method has the advantage of allowing a greater range of designs for the shape of the window than are possible if the entire raised area is wider than the security element 13, which would be limited to geometric shapes, such as rectangles.

Whilst it is preferred that the invention is made in a single ply of paper to form transparent or translucent windows, it is also possible to laminate a second ply of paper to the back of the wide flexible elongate element.

EXAMPLE 1

Figure 2:
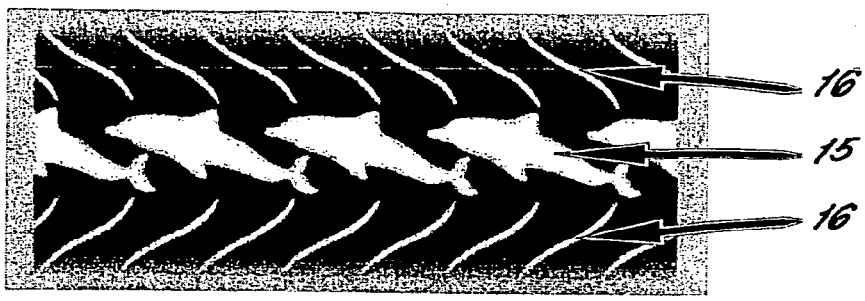
FIGS. 2 to 6 are alternative arrangements of embossings and blindings for use on cylinder mould covers as shown in FIG. 1.
Figure 3:
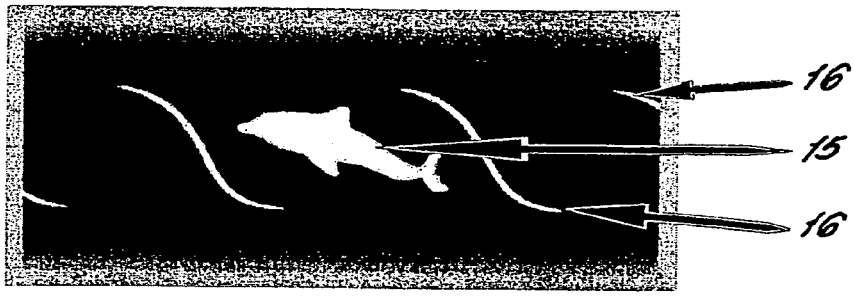

In the example shown in FIG. 2, the dolphins forming the first set of raised portions 15 may be 12 mm wide, whilst the waves at the edges, forming the second set of raised portions 16, extend to 35 mm, i.e. considerably wider than the element 13, which is 18 mm wide. A series of windows is formed in the shape of dolphins when the element 13 is laid on the raised portions 15. The element 13, being impermeable, blinds the mould cover in that region. The element 13 is supported on the waves, which are shaped to allow the flow of fibres between the raised portions 15, 16, allowing paper to form in these regions. Windows are also formed by the waves where they are in contact with the element 13.

EXAMPLE 2

In the example shown in FIG. 3, the embossing of the dolphin is 12 mm wide and the wave supports are 18 mm wide. When an 18 mm wide element 13 is run on the embossing a 12 mm wide window is formed in the shape of the dolphin and the waves are also exposed as windows where the element 13 is in contact. The waves again are shaped to encourage the flow of fibre into the regions between the dolphins.

EXAMPLE 3

Figure 4:
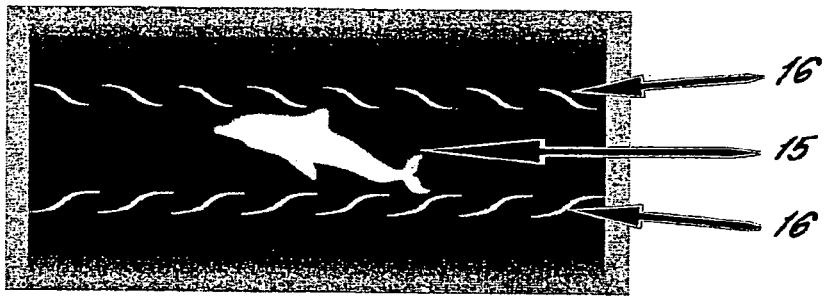

The example shown in FIG. 4 is similar to that shown in FIG. 3 except that the waves are positioned at the edges of the dolphin to provide individual supports 18 mm apart, i.e. the width of the element 13. Again the waves assist the flow of fibre to form paper between the raised portions 15, 16.

EXAMPLE 4

Figure 5:
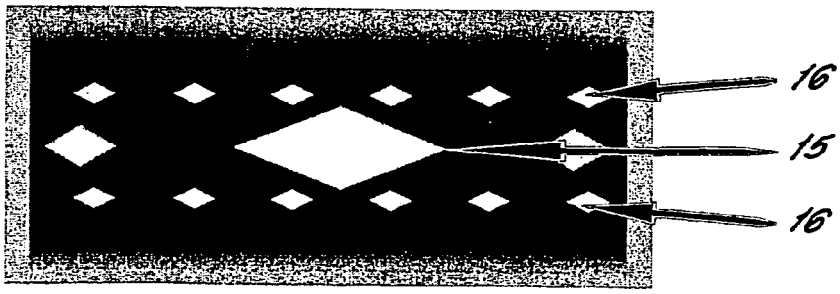

In example 4 shown in FIG. 5 a window is formed in the shape of a large diamond which is 12 mm wide by 30 mm long. The smaller diamonds above and below provide support in the machine direction, to prevent surfacing of the element 13 between windows. The smaller diamonds at the sides are the raised portions 16 for supporting the edges of the element 13 and allow the fibres to flow in underneath the element 13 and form paper in the dark areas of the diagram. These will also appear as minor windows where the element 13 contacts them.

EXAMPLE 5

Figure 6:
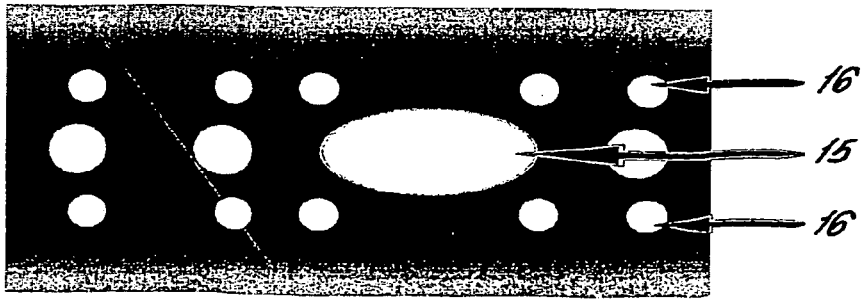

The example shown in FIG. 6 is similar to that shown in FIG. 5 except that the large window 15 in the centre is formed in the shape of an ellipse, which is 12 mm wide by 30 mm long. The smaller ellipses above and below provide support in the machine direction to prevent surfacing of the element between windows. The element 13 is 18 mm wide whilst the smaller ellipses 16 which support the edges of the element have a transverse width of 22 mm, i.e. greater than the width of the substrate. Part of the ellipses 16 will appear as minor windows where the element 13 contacts them.

This process therefore enables a wide strip of an impermeable element 13, of a preferred width of at least 6 mm and preferably in the range of 6 mm to 100 mm or wider, to be included in the paper. The width of the element 13 could be very close to the width of a security document made from the paper, so that in finished documents just a narrow margin of paper runs down each edge of the document. (NB: although the element 13 in such a context may not be narrow and elongate and therefore appropriate to be described as a strip with respect to the finished banknote, it is a strip with respect to the full sheet of paper during manufacturing. Thus any reference in this specification to a "strip" should be interpreted accordingly). When viewed in reflection from the wire side, large transparent windows can be seen which are highly visible.

A wide strip of the impermeable element 13 may be used as a display surface for indicia, for example, de-metallised images, holographic images, colour-shifting areas, print or combinations of any or all of these which are highly visible in the large windows. However, if a plain clear element 13 is used, the windows will be partially translucent or wholly transparent. When viewed in transmission, from the wire side the indicia, the metallisation or colouring on the fully embedded edges of the element 13 also become visible. These edges may be provided with indicia which bleed from or complement any indicia contained on the exposed portion of the element 13.

One preferred material for the element 13 is BOPP of, say, 20 micrometers thickness as this would help to maintain the "flatness" of the paper over the windowed region. However, other materials such as PE, PET or PK with other thicknesses may be used.

In one embodiment, de-metallised images are used which have large areas of transparent regions to provide a greater contrast within the windows between the metallised and non-metallised areas. When the sheet is viewed from the "wire side", the visibility of the bridges between the windows is enhanced by its contrast to the metallisation.

The element 13 can advantageously be used as an information carrier and/or can contain a wide variety of known security features. These may include the following;

- de-metallised designs, which may comprise areas of substantially removed metal to take advantage of the transparency of the base film and provide a large area of transparent window;
- holographic designs, which could comprise areas of full metal and half-tone screens to provide partial transparency and/or no metal. Under certain viewing conditions, with no metal, a holographic image is still visible;

front to back print registration, in which features are printed which would clearly exhibit Moiré patterns from both front and back if a counterfeit were attempted. Alternatively, such patterns could be produced on a transparent film prior to insertion of the element 13 into the paper as a security feature itself. The exact reproduction of such patterns are very difficult to mimic;

different coloured print showing on the front to the back. The print may be on either side of the strip or both on the same side, with one colour hidden by the other on one side but showing through on the other side;

liquid crystal films, such as those described in WO-A-94/02329, in which colour changes are visible when a molecular liquid crystal material is coated onto a watermark. Due to the scatter effect of the paper surface, a large percentage of the possible colour intensity is lost. By using a fully transparent window, a very vivid colour change is visible both in reflection and transmission;

luminescent or magnetic materials;

embedded de-metallised regions. As the areas of the element 13 at each edge are completely embedded, these can contain a de-metallised type image which would only become visible when the document was viewed in transmission. This area may also mimic a similar adjacent area which is visible in reflection and transmission or the metallisation could bleed out to the adjacent area;

security embossing of transparent film with a security design (e.g. a treasury seal) created during the printing process. These may be blind embossed to produce a tactile/visible feature or could include printing inks to further enhance visibility;

contact measurements in which at least one side of the element is available for contact along its entire length. Measurements can include resistance measured on a current being passed through the element; contact to microcircuitry embedded within the element; contact to activate a material within the element, e.g., PVDF electrochromic; conductive polymers;

With such a large area available, it is possible to combine many features together on a element 13.

In addition, the element 13 could be perforated with holes of various shapes to provide novel features or possibly machine readability, e.g. via airstreams.

The paper described above can be cut and printed to make all forms of documents, including security documents such as banknotes, cheques, travellers cheques, identity cards, passports, bonds etc.

The invention claimed is:

1. A method of manufacturing paper comprising the steps of first bringing an elongate; flexible, impermeable element into contact with a support surface prior to their entry into a vat of aqueous paper stock, said element having a width of at least 6 mm, then depositing fibres onto the support surface to form paper, the deposition of fibres being carried out in such a manner that as fibres are deposited on the support surface, the elongate element is incorporated in the paper with regions of the element at least partially exposed at at least one surface of the paper at at least two sets of windows at spaced locations, said at least two sets of windows being formed by two sets of portions which are raised from the support surface relative to adjacent areas of the support surface, in which a first set of raised portions has a width transverse to a machine direction in which the paper travels during manufacture, which width is narrower than the width of the elongate element, and the second set of raised portions has a width transverse to a machine direction in which the paper travels during manufacture, which width is at least equal to the width of the elongate element, such that during manufacture of the paper the elongate element is brought into contact with both sets of raised portions, with edges of the elongate element being supported by the second set of raised portions, the second set of raised portions allowing paper fibres to deposit between the windows.

2. A method of manufacturing paper as claimed in claim 1 in which the surface area of each of the raised portions of the first set is greater than the surface area of each of the raised portions of the second set.

3. A method of manufacturing paper as claimed in claim 1 in which a first plurality of the raised portions of the second set are provided on one side of the first set of raised portions and a second plurality are provided on the other side, such that the transverse distance between outer edges of the two pluralities of raised portions is at least equal to the width of the elongate element.

4. A method of manufacturing paper as claimed in claim 1 in which the raised portions are formed by embossings of the support surface.

5. A method of manufacturing paper as claimed in claim 1 in which the raised portions are formed by blinded regions of the support surface.

6. A method of manufacturing paper as claimed in claim 1 in which the raised portions are formed by a combination of embossings and blinded regions.

7. A method of manufacturing paper as claimed in claim 1 in which the support surface is a cylinder mould cover.

8. A method of manufacturing paper as claimed in claim 1 further comprising the step of laminating a second ply of paper to cover the back of the elongate element.

9. A sheet of paper made by the method of claim 1.

10. A sheet as claimed in claim 9 in which the elongate element is a security element having one or more security features.

11. A security document comprising or produced from a sheet as claimed in claim 9.

12. A security document as claimed in claim 11 in which the width of the elongate element is the same as the width of the document.

13. A method of manufacturing paper as claimed in claim 1, wherein said raised portions of said second set of raised portions are shaped to encourage flow of paper fibres between the raised portions.

14. A method of manufacturing paper as claimed in claim 13, wherein said raised portions of said second set of raised portions are wave shaped.

15. A method of manufacturing paper as claimed in claim 13, wherein said raised portions of said second set of raised portions are diamond shaped.

16. A method of manufacturing paper as claimed in claim 13, wherein said raised portions of said second set of raised portions are oval shaped.

* * * * *